US005791997A

United States Patent [19]

Barney et al.

[11] Patent Number: 5,791,997

[45] Date of Patent: Aug. 11, 1998

[54] METHOD AND APPARATUS FOR FABRICATING ONE PIECE ALL METAL PREVAILING TORQUE LOCKNUT FASTENERS

[75] Inventors: John Alan Barney, Hudson; Erich Pansegrau, Akron, both of Ohio

[73] Assignee: Tri-State Tool & Die, Stow, Ohio

[21] Appl. No.: 738,270

[22] Filed: Oct. 25, 1996

[51] Int. Cl.[6] ..... B21D 53/24

[52] U.S. Cl. ..... 470/18; 470/25; 470/87

[58] Field of Search ..... 470/18, 19, 20, 470/21, 25, 87, 88, 107, 108, 109; 72/197

[56] References Cited

U.S. PATENT DOCUMENTS

| | | | |
|---|---|---|---|
| 3,171,459 | 3/1965 | Storch | 470/19 |
| 3,354,926 | 11/1967 | Mattick | 470/87 |
| 3,412,722 | 11/1968 | Meyforth et al. | 470/19 |
| 3,621,502 | 11/1971 | Velthoven | 470/87 |
| 4,038,714 | 8/1977 | Werner | 10/86 A |
| 4,110,858 | 9/1978 | Kerr | 470/87 |
| 4,422,196 | 12/1983 | Skinner | 470/25 |
| 4,509,220 | 4/1985 | Cooper et al. | 470/25 |
| 5,499,893 | 3/1996 | Thurston et al. | 470/19 |

FOREIGN PATENT DOCUMENTS 1119440 8/1981 Canada .

OTHER PUBLICATIONS

"Fasteners: How and Why—A Basic Understand of Fasteners and How to Use Them Correctly" published by MacLean-Fogg Co. of Mundelein, Illinois, and having a 1979 copyright notice marking.

"Grade and Source Identification Marking of Prevailing—Torque Type Hex Nuts Inch and Metric" published by Industrial Fasteners Institute of Cleveland, Ohio, which was issued Jan. 10, 1967, and revised Dec. 20, 1993.

"Locknuts" published by Aztech Engineering, Inc. of Dowers, Grove, Illinois, having what appears to be a 1989 copyright notice marking.

Advertisement for Diversified Fasteners, Inc. of Bristol, Indiana, published in the Fall, 1988, issue of "LINK—The Magazine for Fastener Distributors" publication.

"Quality Fasteners Since 1904" published by Gripco of South Whitley, Indiana, publication date unknown.

Advertisement for Lok-Mor, Inc. of Arlington, Texas, published in the Winter, 1995, issue of the "LINK—The National Magazine For Fastener Distributors" publication.

"STOVER ... The Most Widely Used Locknut in the World" published by RB&W Corporation of Mentor, Ohio having a 1982 copyright notice marking.

*Primary Examiner*—Lowell A. Larson
*Assistant Examiner*—Ed Tolan
*Attorney, Agent, or Firm*—Oldham & Oldham Co., L.P.A.

[57] ABSTRACT

Method and apparatus for modifying conventional internally threaded nut blanks to form one piece all metal prevailing torque locknut fasteners having uniform, repeatable torque characteristics when engaged with conventional bolt threads. This is accomplished by positioning the conventional internally threaded nut blanks in a single file in an orientation with their base facing downward and their arcuate crown portion facing upward and feeding these conventional internally threaded nut blanks one at a time between a first rotating deforming wheel having a substantially "v-shaped" groove on an end surface thereof, the substantially "v-shaped" groove corresponding to the arcuate crown portion of the conventional internally threaded nut blanks, the rotating deforming wheel rotating at a predetermined rotational speed and in a first rotational direction, and a rotating backing wheel positioned a predetermined distance from the rotating deforming wheel, the rotating backing wheel including a flat surface on its end surface corresponding to the base of the conventional internally threaded nut blanks, the rotating deforming wheel rotating at the same predetermined rotational speed as the rotating backing wheel, but in a second rotational direction opposite to that of said wheel.

5 Claims, 2 Drawing Sheets

METHOD AND APPARATUS FOR FABRICATING ONE PIECE ALL METAL PREVAILING TORQUE LOCKNUT FASTENERS

BACKGROUND AND SUMMARY OF THE INVENTION

The present invention relates generally to a new and novel method and apparatus for fabricating internally threaded fasteners which provide interfering engagement with conventional bolt threads. More particularly, the present invention relates to a new and novel method and apparatus for modifying conventional internally threaded nut blanks to form one piece all metal prevailing torque locknut fasteners having uniform, repeatable torque characteristics when engaged with conventional bolt threads.

Two types of locknut fasteners have traditionally been used in conjunction with conventional bolt threads to provide a fastener which requires additional torque for disassembly as compared with a conventional fastener. The first type of locknut fasteners, prevailing torque locknut fasteners, rely on some form of mismatch in the locknut thread form in relation to the conventional threaded bolt body when assembled together. The other type of locknut fasteners, free spinning or free running locknut fasteners, utilize an axial load applied to the base of the nut to "lock" or restrict movement between the locknut fastener and the conventional threaded bolt body. The first type of locknut fasteners, prevailing torque locknut fasteners, have become widely accepted due to their economical fabrication cost, ease of use and reliability in a wide variety of applications. Prevailing torque locknut fasteners can be divided into two general categories, insert type prevailing torque locknut fasteners, which depend upon an insert, such as a compression collar, in the interior threads of the locknut fastener, and one piece all metal prevailing torque locknut fasteners. Insert type prevailing locknut fasteners are self locking due to plastic deformation of the insert regardless of the amount of bolt tension, however, such insert type prevailing locknut fasteners are generally relatively expensive to fabricate as compared to one piece all metal prevailing torque locknut fasteners. Accordingly, one piece all metal prevailing torque locknut fasteners have found wide acceptance due to their economical cost and applicability to a wide variety of products and applications.

Many varieties of one piece all metal prevailing torque locknut fasteners are currently available. However, all of these known prior art one piece all metal prevailing torque locknut fasteners induce their locking characteristics through either pitch distortion of the internal nut threads, nut ovalization or some combination of these two. One piece all metal prevailing torque locknut fasteners which utilize thread pitch distortion to provide prevailing torque tend to experience a relatively rapid decline in prevailing torque capability through subsequent reuse. On the other hand, one piece all metal prevailing torque locknut fasteners utilizing nut ovalization generally experience a reduced rate of decrease in prevailing torque capability through subsequent reuse.

Ovalized one piece all metal prevailing torque locknut fasteners have traditionally been fabricated using one of two methods. The first method generally utilities a press having a vertical stroke with a plate or die which corresponds to the shape of the crown portion of the conventional internally threaded nut blanks which are to be fabricated into one piece all metal prevailing torque locknut fasteners. Using this method, a conventional internally threaded nut blank is positioned on a table with its crown portion facing upward and the plate or die engages and deforms, in most cases, three sides of the crown portion and sides of the conventional internally threaded nut blank to deform or ovalize the internal thread configuration of the conventional internally threaded nut blank into an internal thread configuration having three (3) "flats" or distorted sections which approach the configuration of an equilateral triangle.

One significant drawback of using a press to fabricate one piece all metal prevailing torque locknut fasteners is that, when utilizing a press, it is generally necessary to go through the steps of loading a conventional internally threaded nut blank in position on a table, going through the press stroke cycle and then removing the formed one piece all metal prevailing torque locknut fastener from the table. These steps can be time consuming and often result in a slower locknut production rate. Furthermore, presses are generally noisy and all deformation or ovalization of the conventional internally threaded nut blank threads is generally accomplished in a single press stroke, thus requiring a relatively large force to be exerted over a relatively short period of time to form one piece all metal prevailing torque locknut fasteners using a press.

It is generally desirable to deform or ovalize the first two to five threads of a conventional internally threaded nut blank to provide a balance between maximizing the number of free running threads which are available before the deformed or ovalized threads engage the conventional bolt threads on one hand and not relying on only one deformed or ovalized thread to provide the prevailing torque to "lock" the locknut to the conventional bolt threads on the other hand.

Many standards directed to one piece all metal prevailing locknut fasteners require a minimum number of free running threads before the deformed or ovalized threads are engaged, thus limiting the number of threads in a conventional internally threaded nut blank which can be deformed or ovalized. These same standards also require one piece all metal prevailing torque locknut fasteners to maintain a minimum prevailing torque capability when the one piece all metal prevailing torque locknut fastener has been engaged and disengaged from a conventional threaded bolt body a predetermined number of times, in many cases, five times. If only one or two threads are relied upon to provide the prevailing torque capability, this repeated assembly/disassembly minimum prevailing torque capability requirement can be difficult to meet. Thus, it is advantageous to have a one piece all metal prevailing torque locknut fastener fabrication process which is capable of uniformly deforming or ovalizing a predetermined number of threads in conventional internally threaded nut blanks.

An example of a prior art method of making locknuts utilizing the rotation of indented teeth formed on wheels is described in U.S. Pat. No. 4,038,714 to Werner. The use of wheels to modify conventional internally threaded nut blanks to form locknut fasteners generally increases the one piece all metal prevailing torque locknut fastener production rate. However, one piece all metal prevailing torque locknut fasteners produced utilizing the method described in U.S. Pat. No. 4,038,714 to Werner have a series of indentations on two opposed side walls. A drawback of one piece all metal prevailing torque locknut fasteners fabricated in accordance with the method described in the U.S. Pat. No. 4,038,714 to Werner is that since the series of indentations, and thus the deformation or ovalization of the threads, extend significantly into the opposed side walls, more than the desired number of threads are deformed or ovalized, and the industry standards requirement of a minimum number of free running threads before the deformed or ovalized threads are engaged is difficult to meet. One possible way of increasing the number of free running threads before the deformed or ovalized threads are engaged is to use conventional internally threaded nut blanks having oversized internal threads to form one piece all metal prevailing torque locknut fasteners using the method described in U.S. Pat. No. 4,038,714 to Werner. However, the use of conventional internally threaded nut blanks having oversize threads results in a looser or "sloppier" fit with the conventional bolt threads and thus, reduces the force or load carrying capacity of one piece all metal prevailing torque locknut fasteners formed from conventional internally threaded nut blanks having oversize threads. Furthermore, since special taps are generally necessary to fabricate conventional internally threaded nut blanks having oversize threads, such conventional internally threaded nut blanks having oversize threads can be more difficult and expensive to obtain as compared to conventional internally threaded nut blanks having standard threads.

Another drawback of one piece all metal prevailing torque locknut fasteners fabricated in accordance with the method described in U.S. Pat. No. 4,038,714 to Werner is that the conventional internally threaded nut blanks are positioned on their base or bottom surface when the series of indentations are formed and the base or bottom surface of the conventional internally threaded nut blanks are forced downwardly against a stationary base or support surface by the deforming wheels and, while being forced downwardly against the stationary base or support surface, the conventional internally threaded nut blanks are moved or slid across the stationary base or support surface by the deforming wheels. This moving or sliding of the base or bottom surface of the conventional internally threaded nut blanks along the stationary base or support surface, along with the downward force exerted on the conventional internally threaded nut blanks can result in one piece all metal prevailing torque locknut fasteners which are unsightly and, in some cases, can interfere with the assembly and/or function of the one piece all metal prevailing torque locknut fasteners. Furthermore, such moving or sliding of the base or bottom surface of the conventional internally threaded nut blanks along the stationary base or support surface, along with the downward force exerted on the conventional internally threaded nut blanks by the deforming wheels, can also result in excessive wear and tear on the stationary base or support surface. While a lubricating fluid may be used to minimize the score marks on the one piece all metal prevailing torque locknut fasteners, and minimize the extent of excessive wear and tear on the stationary base or support surface, the use of such a lubricating fluid is another operation which has to be monitored and controlled when fabricating one piece all metal prevailing torque locknut fasteners in accordance with the description in U.S. Pat. No. 4,038,714 to Werner.

Another prior art one piece all metal prevailing torque locknut fastener design is described in Canadian Patent No. 1,119,440. This prior art one piece all metal prevailing torque locknut fastener design has many of the same drawbacks as one piece all metal prevailing torque locknut fasteners fabricated in accordance with the method described in U.S. Pat. No. 4,038,714 to Werner as discussed above. These drawbacks include indentations on opposed side walls of the one piece all metal prevailing torque locknut fasteners, thus reducing the number of free running threads before the deformed or ovalized threads are engaged, as well as score marks on the base or bottom surface of the one piece all metal prevailing torque locknut fastener and excessive wear and tear to a stationary base or support surface due to moving or sliding of the base or bottom surface of the conventional internally threaded nut blanks along the stationary base or support surface, along with the downward force exerted on the conventional internally threaded nut blanks by the deforming wheel.

Accordingly, an object of the present invention is the provision of a method and apparatus for fabricating one piece all metal prevailing torque locknut fasteners which is capable of modifying conventional internally threaded nut blanks to form one piece all metal prevailing torque locknut fasteners having uniform prevailing torque characteristics when assembled to conventional bolt threads.

Another object of the present invention is to provide a method and apparatus for fabricating one piece all metal prevailing torque locknut fasteners from conventional internally threaded nut blanks at a relatively rapid one piece all metal prevailing torque locknut fastener production rate.

Yet another object of the present invention is to provide a method and apparatus for fabricating one piece all metal prevailing torque locknut fasteners which is capable of modifying conventional internally threaded nut blanks without scoring the base or bottom surface of the one piece all metal prevailing torque locknut fasteners and without excessive wear and tear to a stationary base or support surface due to relative movement or sliding between the conventional internally threaded nut blank and the stationary base or support surface.

These and other objects of the present invention are attained by the provision of a method and apparatus for modifying conventional internally threaded nut blanks to form one piece all metal prevailing torque locknut fasteners having uniform, repeatable torque characteristics when engaged with conventional bolt threads. This is accomplished by positioning the conventional internally threaded nut blanks in a single file in an orientation with their base facing downward and their arcuate crown portion facing upward and feeding these conventional internally threaded nut blanks one at a time between a first rotating deforming wheel having a substantially "v-shaped" groove on an end surface thereof, the substantially "v-shaped" groove corresponding to the arcuate crown portion of the conventional internally threaded nut blanks. The rotating deforming wheel rotates at a predetermined rotational speed in a first rotational direction and a rotating backing wheel is positioned a predetermined distance from the first rotating deforming wheel, the rotating backing wheel including a flat surface on its end surface corresponding to the base of the conventional internally threaded nut blanks, the rotating deforming wheel rotating at the same predetermined rotational speed as the rotating deforming wheel, but in a second rotational direction opposite to that of the rotating deforming wheel to form the one piece all metal prevailing torque locknut fasteners.

Other advantages and novel features of the present invention will become apparent in the following detailed description of the invention when considered in conjunction with the accompanying drawings.

DETAILED DESCRIPTION OF THE DRAWINGS

Figure 1:
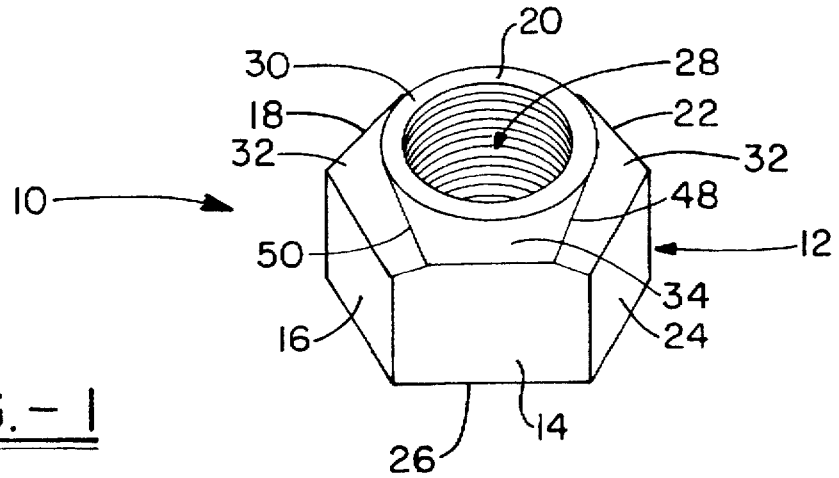
FIG. 1 illustrates a perspective view of a one piece all metal prevailing torque locknut fastener in accordance with a preferred embodiment of the present invention.
Figure 2:
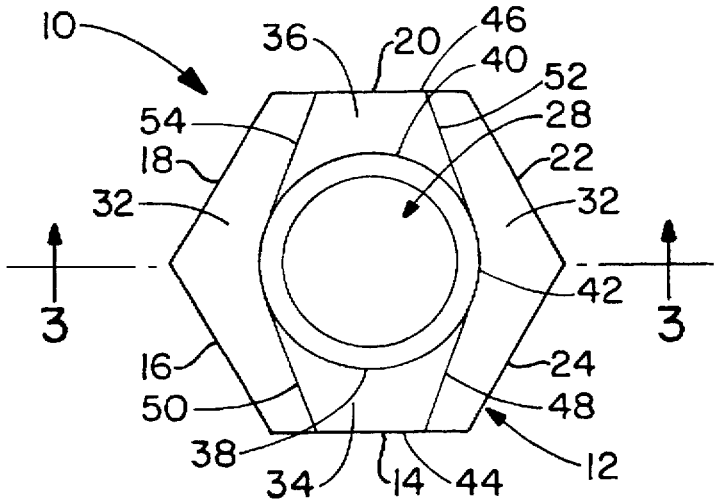
FIG. 2 illustrates a top view of the one piece all metal prevailing torque locknut fastener in accordance with the preferred embodiment of the present invention shown in FIG. 1.
Figure 3:
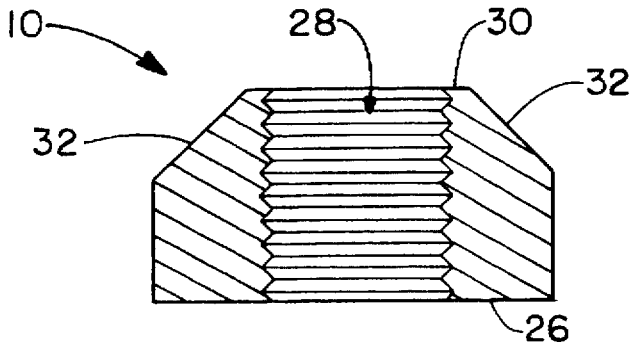
FIG. 3 illustrates a cross-sectional side view of the one piece all metal prevailing torque locknut fastener in accordance with the preferred embodiment shown in FIG. 1.

In the following detailed description of preferred embodiments of the present invention, reference is made to the accompanying drawings which, in conjunction with this detailed description, illustrate and describe a preferred embodiment of a method and device for fabricating one piece all metal prevailing torque locknut fasteners in accordance with the present invention. Referring now to FIGS. 1 through 3, which illustrate a prospective view, a top view and a cross-sectional side view, respectively, of a one piece all metal prevailing torque locknut fastener, generally identified by reference numeral 10, in accordance with a preferred embodiment of the present invention, one piece all metal prevailing torque locknut fastener 10 has a generally hexagonally shaped body, indicated by reference numeral 12, in the form of a conventional internally threaded nut blank. It should be understood that although the present invention is depicted herein in connection with a single exemplary nut size, the concepts of the invention are applicable to the entire range of standard nut sizes.

Generally hexagonally shaped body 12 includes six side surfaces or flats 14, 16, 18, 20, 22 and 24 forming three pairs of opposed flats 14, 20; 16, 22; and 18, 24; each pair of flats lying in substantially parallel planes. The spaced pairs of flats 16, 22 and 18, 24 are preferably in accordance with conventional standard internally threaded nut design, except that a portion of the remaining pair of flats 14, 20 are modified over a portion thereof as hereinafter described.

The lower extremity of hexagonally shaped body 12 of one piece all metal prevailing torque locknut fastener 10 is defined by base or bearing face 26 which is preferably of an annular configuration in accordance with industry standards for conventional internally threaded nut blanks. Base or bearing face 26 is joined to each of the side surfaces or flats 14, 16, 18, 20, 22 and 24 by chamfered surfaces, again in accordance with industry standards for conventional internally threaded nut blanks. Base or bearing surface 26, which is substantially perpendicular to the axis of generally hexagonally shaped body 12, has a central opening or through bore 28 which is also in accordance with industry standards for conventional internally threaded nut blanks.

Central opening or through bore 28 extends from base or bearing surface 26 to top surface 30 which lies substantially in a plane perpendicular to the axis of generally hexagonally shaped body 12 and therefore lies in a plane substantially parallel to the plane of base or bearing surface 26. Top surface 30 is joined to side surfaces or flats 14, 16, 18, 20, 22, 24 and 26 by arcuate crown portion 32 which preferably has the configuration of a frustrum of a cone having an angle of approximately 45° with respect to the plane of side surfaces or flats 14, 16, 18, 20, 22 and 24 which parallel the axis of generally hexagonally shaped body 12. Arcuate crown portion 32 varies from the preferred conical configuration in the areas of side surfaces or flats 14 and 20 in a manner hereinafter described.

One piece all metal prevailing torque locknut fastener 10 includes substantially flat surfaces 34 and 36 on arcuate crown portion 32 corresponding to side surfaces or flats 14 and 20. As seen in FIG. 2, substantially flat surfaces 34 and 36 are preferably shaped substantially as a parallelogram including substantially parallel top surfaces 38 and 40 which extend substantially to top portion 42 of arcuate crown portion 32, substantially parallel bottom surfaces 44 and 46 which extend substantially to the intersection between side surfaces or flats 14 and 20 and arcuate crown portion 32 and angled side surfaces 48, 50, 52 and 54 which preferably angle inwardly from substantially parallel top surfaces 38 and 40 to substantially parallel bottom surfaces 44 and 46. Substantially flat surfaces 34 and 36 are formed by compressing arcuate crown portion 32 above side surfaces or flats 14 and 20 as will be described hereinafter.

Figure 4:
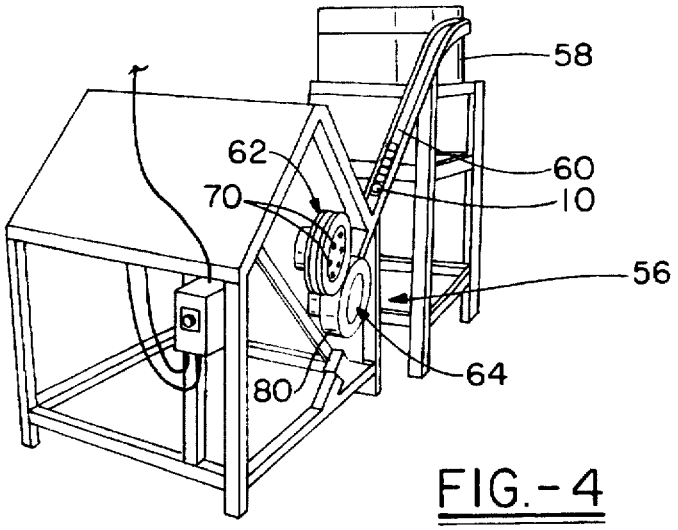
FIG. 4 illustrates a perspective view of an apparatus for modifying conventional internally threaded nut blanks to form one piece all metal prevailing torque locknut fasteners in accordance with the preferred embodiment shown in FIG. 1.
Figure 5:
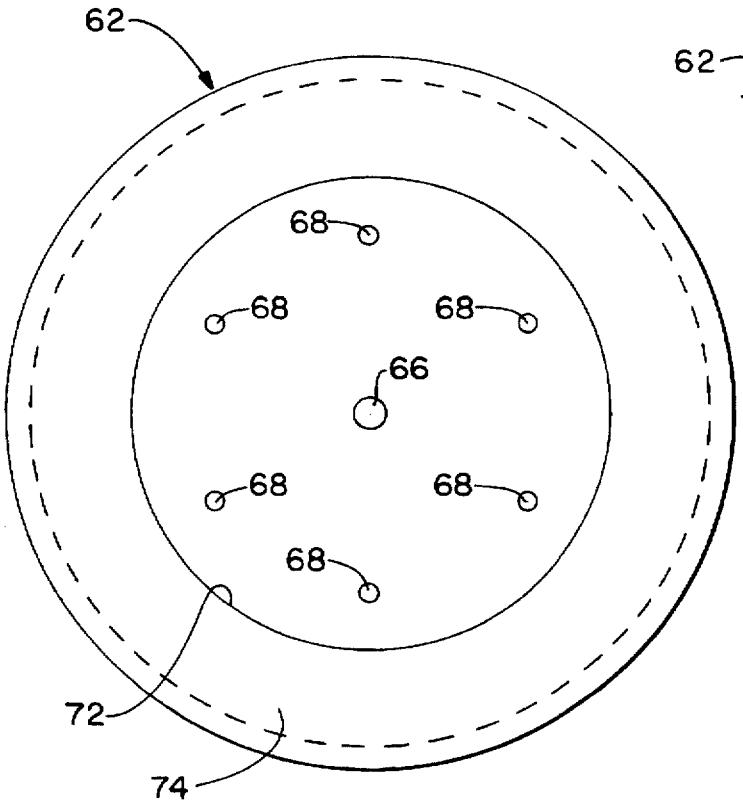
FIG. 5 illustrates an end view of the deforming wheel utilized in the apparatus for modifying conventional internally threaded nut blanks to form one piece all metal prevailing torque locknut fasteners in accordance with the preferred embodiment shown in FIG. 1.
Figure 6:
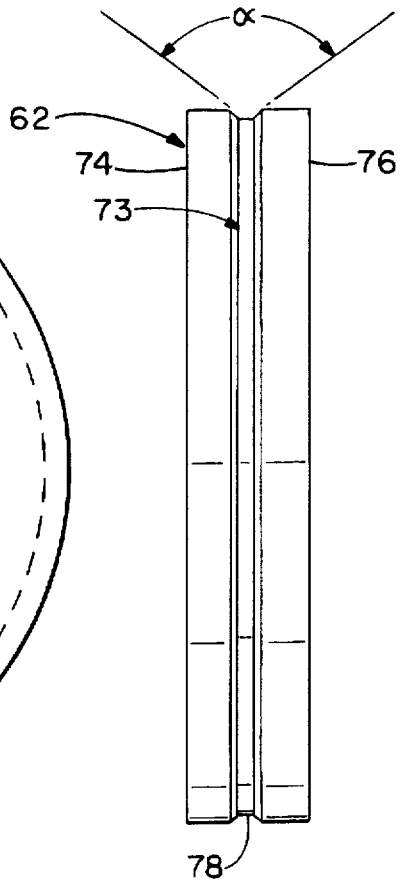
FIG. 6 illustrates a side view of the deforming wheel shown in FIG. 5 utilized in the apparatus for modifying conventional internally threaded nut blanks to form one piece all metal prevailing torque locknut fasteners in accordance with the preferred embodiment shown in FIG. 1.

Referring now to FIGS. 4 through 6, a one piece all metal prevailing torque locknut fastener fabricating apparatus for fabricating one piece all metal prevailing torque locknut fastener 10 in accordance with a preferred embodiment of the present invention is shown, indicated generally by reference numeral 56. One piece all metal prevailing torque locknut fastener fabricating apparatus 56 generally includes a vibratory nut feeder bowl 58, which can be of conventional design, including provisions for orienting conventional internally threaded nut blanks in an orientation with arcuate crown portion 32 facing upward and transporting the conventional internally threaded nut blanks so oriented onto feed track 60. Feed track 60 positions a plurality of properly oriented conventional internally threaded nut blanks in a single file to be fed between rotating deforming wheel 62 and rotating backing wheel 64 one at a time. As will be described hereinafter, rotating deforming wheel 62 deforms arcuate crown portion 32 of the conventional internally threaded nut blanks above side surfaces or flats 14 and 20 to form substantially flat surfaces 34 and 36 while base or bearing face 26 of the conventional internally threaded nut blanks are supported on rotating backing wheel 64.

Referring to FIGS. 5 and 6, which illustrate an end view and a side view, respectively, of rotating deforming wheel 62, rotating deforming wheel 62 includes a central cylindrical aperture or opening 66 which engages with a first rotating shaft (not shown) extending from a source of rotational power, such as an electrical motor (not shown), to locate or centrally position rotating deforming wheel 62 in relation to the first rotating shaft (not shown). Rotating deforming wheel 62 also preferably includes a plurality of bolt holes 68 through which a plurality of conventional fasteners, such as machine bolts 70, extend to rotationally couple rotating deforming wheel 62 with a cylindrical plate (not shown) extending outwardly from the first rotating shaft (not shown). If desired, an interior portion of rotating deforming wheel 62 can include counterbore 72 which corresponds to the cylindrical plate (not shown) extending outwardly from the rotating shaft (not shown) to assist in maintaining the position of rotating deforming wheel 62 in relation to the first rotating shaft (not shown). Thus, rotating deforming wheel 62 is located concentric with first rotating shaft (not shown) extending from the source of rotational power and is rotationally coupled to rotate at the same rotational speed and in the same rotational direction as first rotating shaft (not shown). Rotating backing wheel 64 is rotationally attached and coupled to a second rotating shaft (not shown) in a manner similar to that of rotating deforming wheel 62 and the second rotating shaft (not shaft) rotates at the same rotational speed, but in the opposite rotational direction, as first rotating shaft (not shown).

As seen in FIG. 6, rotating deforming wheel 62 includes substantially "v-shaped" groove 73 located intermediate first side surface 74 and second side surface 76 of rotating deforming wheel 62. Substantially "v-shaped" groove 73 preferably has an included angle $\propto$ in the range of 90° to 120°, more preferably in the range of 100° to 110° and most preferably 106°. The width and depth of included angle $\propto$ corresponds to the width and height of arcuate crown portion 32 of the conventional internally threaded nuts, and thus rotating deforming wheels 62 designed for larger conventional internally threaded nut blanks will have a wider and deeper substantially "v-shaped" groove 73 than will rotating deforming wheels 62 designed for smaller conventional internally threaded nut blanks. Alternatively, the same rotating deforming wheel 62 could be utilized to deform or ovalize smaller or larger conventional internally threaded nut blanks by, respectively, decreasing or increasingly the distance between rotating deforming wheel 62 and rotating backing wheel 64. The distance between rotating deforming wheel 62 and rotating backing wheel 64 can also be increased or decreased to increase or decrease the extent of deformation or ovalization of the conventional internally threaded nut blanks. Furthermore, base portion 78 of substantially "v-shaped" groove 73 can be filled in or flat as shown in FIG. 6 since this portion of substantially "v-shaped" groove 73 is above central opening or through bore 28 of the conventional internally threaded nut blanks and is not used to deform arcuate crown portion 32.

Rotating backing wheel 64 is preferably identical in configuration and size to rotating deforming wheel 62, except rotating backing wheel 64 has a flat surface extending between its first side surface (not shown) and its second side surface 80. Thus, rotating backing wheel 64 rotates at the same rotational speed, but in the opposite rotational direction, as rotating deforming wheel 62, and rotating backing wheel 64 supports base or bearing face 26 of the conventional internally threaded nut blanks while rotating deforming wheel 62 deforms arcuate crown portion 32 of the conventional internally threaded nuts. Since rotating deforming wheel 62 and rotating backing wheel 64 rotate at the same rotational speed, but in opposite rotational directions, both rotating deforming wheel 62 and rotating backing wheel 64 assist in transporting the conventional internally threaded nuts from feed track 60 through the arcuate crown portion 32 deforming operating and away from feed track 60 once arcuate crown portion 32 is deformed to form one piece all metal prevailing torque locknut 10. This deforming or ovalization process is a progressive operation and requires less force exerted over a longer period of time when compared to, for example, a press which requires more force exerted over a shorter period of time. Furthermore, since there is no relative movement between base or bearing face 26 of the conventional internally threaded nut blanks and rotating backing wheel 64, no score marks are formed in base or bearing in face 26 and wear and tear to rotating backing wheel 64 is minimized. In addition, since base or bearing face 26 is flat and rotating backing wheel 64 is curved, some relative movement or "rocking" occurs as the conventional internally threaded nut blanks pass between rotating deforming wheel 62 and rotating backing wheel 64.

Although the present invention has been described above in detail, the same is by way of illustration and example only and is not to be taken as a limitation on the present invention. For example, a rotating deforming wheel and rotating backing wheel arrangement in accordance with the present invention could be utilized to deform or ovalize conventional hex nuts not having arcuate crown portion 32 i.e., a flat top surface. In this case, the included angle of substantially "v-shaped" groove in rotating deforming wheel 62 would preferably be less than 90°. Accordingly, the scope and content of the present invention are to be defined only by the terms of the appended claims.

What is claimed is:

1. An apparatus for fabricating one piece all metal prevailing torque locknut fasteners from conventional internally threaded nut blanks having a base and a arcuate crown portion, comprising:

a feed track to position the conventional internally threaded nut blanks in a single file in an orientation with the base facing downward and the arcuate crown portion facing upward;

a first rotating deforming wheel having a substantially "v-shaped" groove on an end surface thereof, said substantially "v-shaped" groove corresponding to the arcuate crown portion of the conventional internally threaded nut blanks, said rotating deforming wheel rotating at a predetermined rotational speed and in a first rotational direction; and a rotating backing wheel positioned a predetermined distance from said first rotating deforming wheel, said rotating backing wheel including a flat surface on its end surface corresponding to the base of the conventional internally threaded nut blanks, said rotating deforming wheel rotating at the same predetermined rotational speed as said rotating deforming wheel, but in a second rotational direction opposite to that of said rotating deforming wheel; and said backing wheel engaging said base of said nut blank while said "v-shaped" groove on said deforming wheel deforms said crown portion to produce said fasteners.

2. The apparatus for fabricating one piece all metal prevailing torque locknut fasteners in accordance with claim 1, wherein said substantially "v-shaped" groove has an included angle in the range of 90° to 120°.

3. The apparatus for fabricating one piece all metal prevailing torque locknut fasteners in accordance with claim 1, wherein said substantially "v-shaped" groove has an included angle in the range of 100° to 110°.

4. The apparatus for fabricating one piece all metal prevailing torque locknut fasteners in accordance with claim 1, wherein said substantially "v-shaped" groove has an included angle of approximately 106°.

5. A method of fabricating one piece all metal prevailing torque locknut fasteners from conventional internally threaded nut blanks having a base and a arcuate crown portion, comprising the steps of:

positioning at least a portion of the conventional internally threaded nut blanks in a single file in an orientation with the base facing downward and the arcuate crown portion facing upward; and feeding the conventional internally threaded nut blanks between a first rotating deforming wheel having a substantially "v-shaped" groove on an end surface thereof, said substantially "v-shaped" groove corresponding to the arcuate crown portion of the conventional internally threaded nut blanks, said rotating deforming wheel rotating at a predetermined rotational speed and in a first rotational direction, and a rotating backing wheel positioned a predetermined distance from said rotating deforming wheel, said rotating backing wheel including a flat surface on its end surface corresponding to the base of the conventional internally threaded nut blanks, said rotating deforming wheel rotating at the same predetermined rotational speed as said rotating deforming wheel, but in a second rotational direction opposite to that of said rotating deforming wheel; and deforming said nut blank by said backing wheel engaging said base of said nut blank while said "v-shaped" groove on said deforming wheel deforms said crown portion to produce said fasteners.

* * * * *